US009724575B2

(12) United States Patent
Morin et al.

(10) Patent No.: US 9,724,575 B2
(45) **Date of Patent: *Aug. 8, 2017**

(54) GOLF CLUB FACE

(71) Applicant: Acushnet Company, Fairhaven, MA (US)

(72) Inventors: John Morin, Poway, CA (US); Gentry Ferguson, Encinitas, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/976,969

(22) Filed: Dec. 21, 2015

(65) Prior Publication Data

US 2016/0107050 A1 Apr. 21, 2016

Related U.S. Application Data

(63) Continuation of application No. 14/018,716, filed on Sep. 5, 2013, now Pat. No. 9,216,327.

(51) Int. Cl.
*A63B 53/04* (2015.01)

(52) U.S. Cl.
CPC ..... *A63B 53/0466* (2013.01); *A63B 53/04* (2013.01); *A63B 2053/042* (2013.01); *A63B 2053/0408* (2013.01); *A63B 2053/0416* (2013.01); *A63B 2053/0458* (2013.01); *A63B 2053/0462* (2013.01); *A63B 2053/0491* (2013.01)

(58) Field of Classification Search
CPC ..... A63B 53/0466; A63B 2053/042; A63B 2053/0416; A63B 2053/0458; A63B 2053/0462
USPC ..... 473/342, 329, 350, 349
See application file for complete search history.

(56) References Cited

U.S. PATENT DOCUMENTS

| | | | | |
|---|---|---|---|---|
| 5,735,755 | A * | 4/1998 | Kobayashi | A63B 53/04 473/331 |
| 8,439,769 | B2 | 5/2013 | Rice et al. | 473/329 |
| 2002/0019265 | A1 | 2/2002 | Allen | 473/329 |
| 2005/0233830 | A1 | 10/2005 | Williams | 473/342 |
| 2005/0278931 | A1 | 12/2005 | Deshmukh et al. | 29/469 |
| 2010/0022328 | A1 | 1/2010 | Yokota | 473/349 |
| 2010/0255930 | A1 | 10/2010 | Rice et al. | 473/329 |
| 2012/0010020 | A1 | 1/2012 | Golden et al. | 473/342 |

* cited by examiner

*Primary Examiner* — Benjamin Layno
(74) *Attorney, Agent, or Firm* — Smith, Gambrell & Russell, LLP

(57) ABSTRACT

A golf club head including a club face constructed from a low modulus material for maximizing driving distance potential and a perimeter flange having a mass reducing configuration for preventing adverse influences to the center of gravity and the moment of inertia of a golf club head including the club face.

20 Claims, 5 Drawing Sheets

GOLF CLUB FACE

CROSS-REFERENCE TO RELATED APPLICATIONS

This application is a continuation of U.S. patent application Ser. No. 14/018,716, filed Sep. 5, 2013, now U.S. Pat. No. 9,216,327, the entire disclosure of which is incorporated by reference herein.

FIELD OF THE INVENTION

The present invention relates to a golf club face. More particularly, the present invention relates to a cup face insert for a metal wood golf club constructed from a low modulus metal and having a mass-reducing configuration in a perimeter flange.

BACKGROUND OF THE INVENTION

By varying design specifications, a golf club can be tailored to have specific durability and performance characteristics. However, golf club design is a complex matter such that altering the specifications for even one component of the club (i.e., the club head, the shaft, the grip, and subcomponents thereof) directly affects the durability and performance of the club.

For example, a number of factors contribute to the maximum distance and the trajectory accuracy of a metal wood golf club. Among the factors contributing to these properties is the flexibility of the club face, the center of gravity of the club head, and the moment of inertia of the club head. In particular, a golf club head with a higher flexibility may confer a greater impact force to a golf ball, and generally drive the ball further. The flexibility of a golf club may be measured in terms of Coefficient or Restitution (COR) or Characteristic Time (CT), the measuring procedures for both of which are well known to those skilled in the art. Higher COR and/or CT values are indicative of higher flexibilities in golf club heads and, thus, longer driving potential.

However, varying the construction of a club face in an effort to achieve higher flexibility may negatively influence other characteristics of the club head as a whole and, more particularly, the maximum driving distance. Indeed, a variation to the club face construction that negatively influences the center of gravity or the moment of inertia of the club head may lessen the maximum driving distance by presenting a tendency for excessive loft and/or a tendency for a slice trajectory.

In addition, golf club heads must be strong overall to withstand the repeated impacts incurred by striking golf balls with the club head. The loading that occurs during this transient event can create a peak force of over 2,000 pounds. Thus, a major challenge to golf club manufacturers is to achieve a club face and body design that is able to resist permanent deformation or failure due to material yield or fracture. Manufacturers have attempted to address such strength requirements in hollow metal wood drivers by forming the club head from titanium. Titanium and its alloys are low density (roughly half the weight of steel, nickel and copper alloys). However, even when using titanium, a club head is typically constructed of three to four pieces welded together since each different piece (i.e., the face, the crown, the skirt, and the sole) incurs different stresses and roles during play. For example, the mechanical properties needed to produce a high COR face are not the same as the crown. As such, the manufacturing time and cost may be high and, in addition, the desire to create a low mass face without increasing stress in other areas of the club head is difficult to achieve.

Accordingly, there remains a continuing need in the art for golf club face constructions that increase the maximum COR or CT, minimize negative influences to the center of gravity and moment of inertia of the club head, reduce stress in other areas of the club head, and maximize the driving distance and trajectory accuracy. The present invention addresses such needs in both USGA-regulation conforming clubs and non-conforming recreation clubs. In particular, in one embodiment of the present invention, the club head satisfies the limitations have been placed on the maximum permissible COR and CT by the United States Golf Association (USGA) (i.e., maximum COR of 0.830 and maximum CT of 257 us). In another embodiment aspect, the club head of the invention is intended for recreational play and achieves a maximum COR and/or maximum CT that exceeds the USGA regulations.

SUMMARY OF THE INVENTION

The present invention is directed to a golf club head including a face and a body, wherein the face includes: a striking wall including an outer surface configured to strike golf balls and an inner surface configured to face inward of the golf club head, wherein the inner surface of the striking wall includes a center region, and the striking wall further includes a perimeter flange, the perimeter flange including a plurality of regions on the inner surface of the striking wall that extend about the center region, wherein the perimeter flange includes a mass reduction configuration in the form of a cavity pattern, the cavity pattern including a plurality of blind cavities that are uniformly shaped, uniformly dimensioned, uniformly oriented, uniformly spaced, or combinations thereof.

In one embodiment, the low modulus material has a modulus of elasticity of less than about 16,000 kpsi. In another embodiment, the low modulus material has a modulus of elasticity of less than about 15,000 kpsi.

The plurality of blind cavities may be uniformly shaped, uniformly dimensioned, uniformly oriented, and/or uniformly spaced within the cavity pattern. In one embodiment, each cavity in the plurality of blind cavities is formed in at least one shape selected from the group consisting of circles, hexagons, triangles, squares, rectangles, and ovals. In another embodiment, the plurality of blind cavities are circular-shaped cavities having a diameter of about 3 mm to about 5 mm and are separated from one another by a webbing measuring about 2 mm to about 4 mm. In yet another embodiment, the plurality of blind cavities are hexagon-shaped cavities having an apothem of about 1.25 mm to about 1.75 mm and are separated from one another by a webbing measuring about 2 mm to about 4 mm. In still another embodiment, the cavity pattern has an area ratio of cavity area to surface area from about 8 to about 20.

The center region of the club face may include at least a first region having a first thickness between about 3 mm and about 4 mm and a second region having a second thickness between about 2.4 mm and about 2.8 mm, and wherein the second thickness is less than the first thickness. In one embodiment, the second region includes the centermost portion of the striking wall. Alternatively, the center region of the club face may include at least a first region having a first thickness between about 3 mm and about 4 mm and a second region having a second thickness between about 2.4 mm and about 2.8 mm, and wherein the second thickness is less than the first thickness. In one embodiment, the first region includes the centermost portion of the striking wall.

In one embodiment, the face is a cup face insert configured for mating with the body. In another embodiment, the golf club head has a COR of at least about 0.850. In yet another embodiment, the golf club head has a CT of 300 us or more.

The present invention is also directed to a golf club head including a face and a body, wherein the face includes: a striking wall including an outer surface configured to strike golf balls and an inner surface configured to face inward of the golf club head, wherein the striking wall is formed of a low modulus material, wherein the inner surface of the striking wall includes a center region including at least two regions having different wall thicknesses, wherein the striking wall further includes a perimeter flange, the perimeter flange including at least a toe area and a heel area of the face, wherein the perimeter flange includes a mass reduction configuration in the form of a cavity pattern including a plurality of cavities, and wherein the golf club head has a COR of at least about 0.850, a CT from at least about 302 us, or a combination thereof.

In one embodiment, the low modulus material has a modulus of elasticity of about 15,000 kpsi or less. In another embodiment, the low modulus material has a modulus of elasticity of about 14,500 kpsi or less. In yet another embodiment, the low modulus material has a density of at least about 0.17 lb/in$^3$.

The present invention is also directed to a golf club head including a face and a body, wherein the face includes: a striking wall including an outer surface configured to strike golf balls and an inner surface configured to face inward of the golf club head, wherein the striking wall is formed of a low modulus material having a modulus of elasticity of about 15,000 kpsi or less and a density of at least about 0.168 lb/in3, wherein the inner surface of the striking wall includes a center region, wherein the striking wall further includes a perimeter flange surrounding the center region, wherein the perimeter flange includes a mass reduction configuration in at least a toe area and a heel area the form of a cavity pattern including a plurality of cavities, and wherein the golf club head has a COR of greater than about 0.850.

In one embodiment, the low modulus material includes Ti-15-3-3-3. In another embodiment, the density is at least about 0.17 lb/in3 and the modulus of elasticity of about 14,500 kpsi or less.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

The following disclosure discusses the present invention with reference to the examples shown in the accompanying drawings, and illustrates examples of the invention though does not limit the invention to those examples.

The present invention is directed to a golf club head (and portions thereof) for a metal wood golf club that is constructed at least in part from a low modulus material, and which includes a mass reducing configuration. In one aspect, the club head of the invention includes a low mass club face at least for increased COR. In another aspect, the club face includes a face insert with a variable thickness at least for distribution of the mechanical stress. In another aspect, the club head of the invention includes a weight-saving perimeter structure. In yet another aspect, the club head of the invention includes a combination of these features. For example, a low mass club face coupled with a face insert may be incorporated into a club head with a weight-saving perimeter structure.

The present invention, however, takes advantage of the lower elastic modulus of low modulus metals to achieve increased COR or CT characteristics, while at the same time avoiding the disadvantages of the higher density that accompanies such low modulus metals, and their impact on center of gravity and moment of inertia. The particulars of the present invention are discussed in detail below.

The Club Face Design

Figure 1:
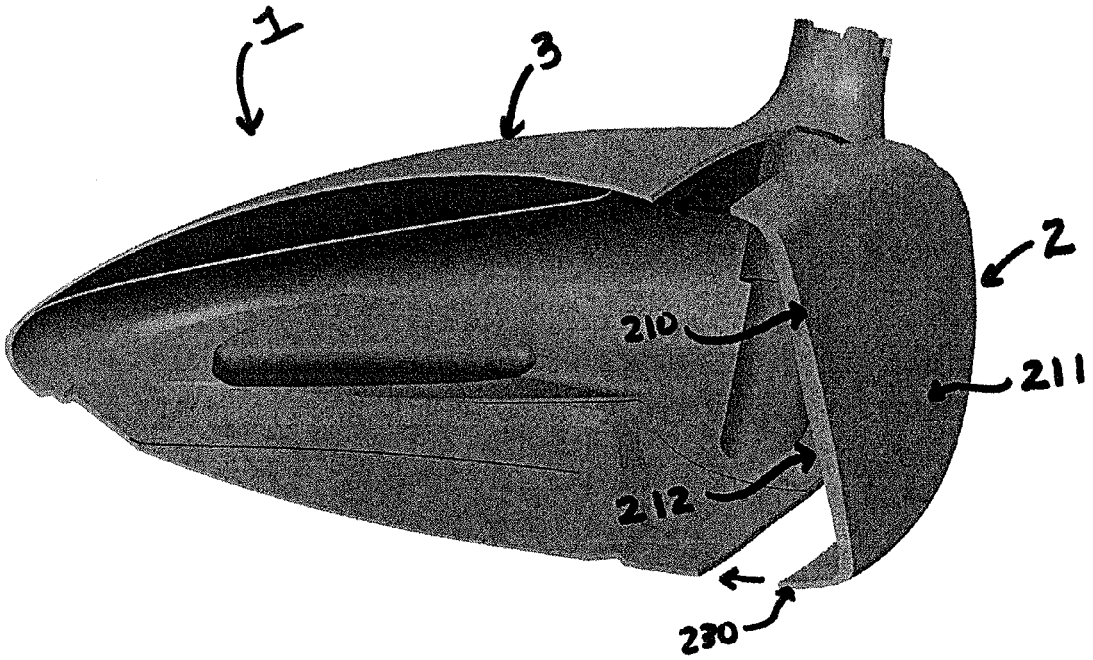
FIG. 1 illustrates a perspective view of a golf club head according to the present invention.

The club face 2 may have a general cup shape that is incorporated into a multi-piece golf club head 1. As shown in FIG. 1, the club face 2 is configured to mate with an aft body 3 in the assembly of a golf club head 1.

As shown in FIG. 1, the club face 2 includes a striking wall 210 and a rim 230. The striking wall 210 includes an outer surface 211 and an inner surface 212, with the club face 2 configured such that, in an assembled state, the outer surface 211 faces outwardly, away from the aft body 3 for striking golf balls; and the inner surface 212 faces inwardly, toward the aft body 3. The rim 230 extends from the striking wall 210 for mating with the aft body 3 to assemble the club head 1. In one example, a rim 230 may diverge from a plane along which the striking wall 210 generally extends, by either a curvature (not shown) or a sharp corner (generally shown), to extend rearward of the striking wall 210 and mate with a recessed channel (not shown) formed in a perimeter of the aft body 3. In other examples, as shown in FIG. 1, however, a rim may simply extend for a length along a common plane that the striking wall 210 generally extends and mate with a stepped surface formed around a periphery at the front of the aft body 3.

Figure 2:
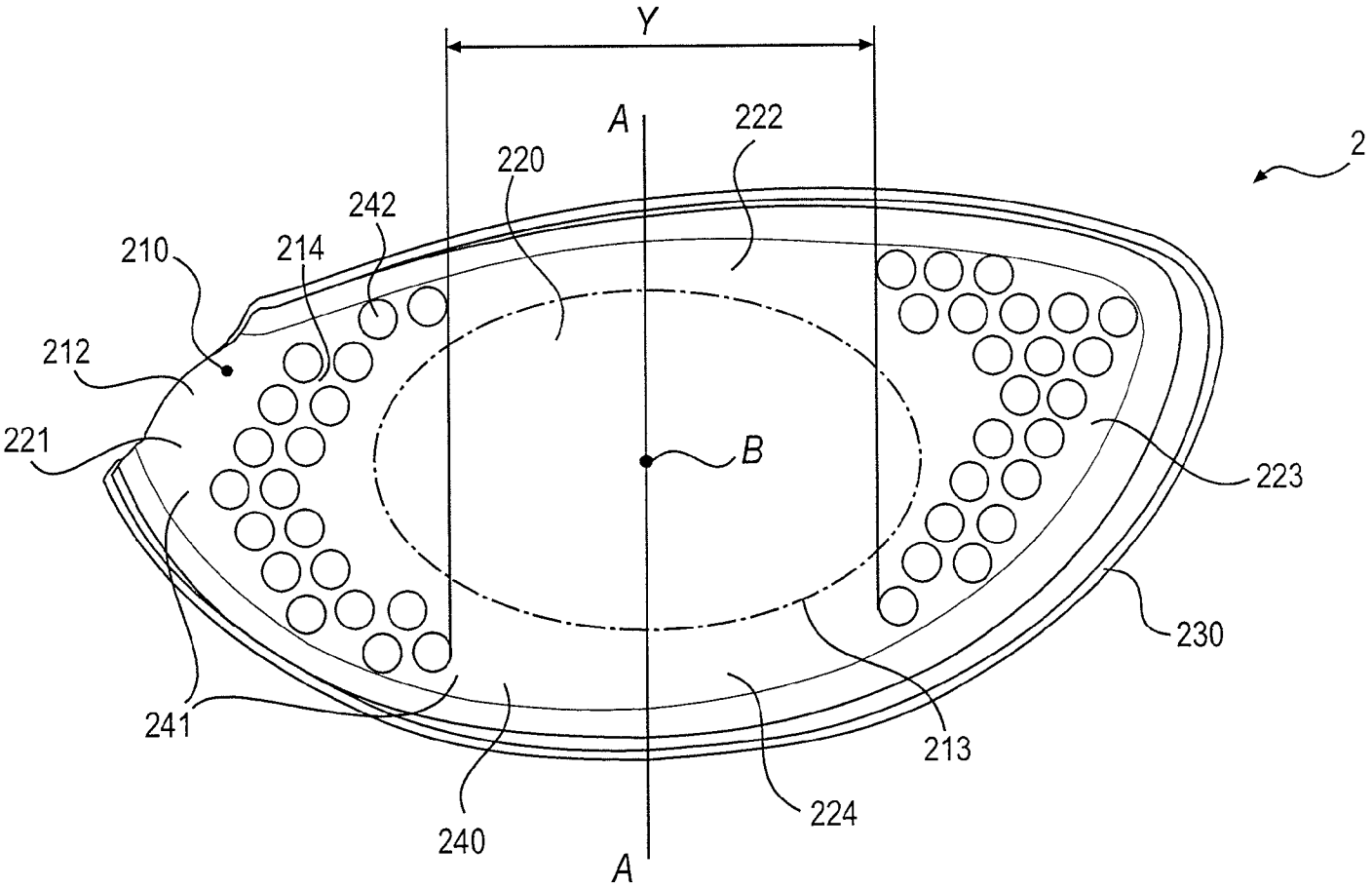
FIG. 2 illustrates a golf club face according to an embodiment of the present invention.

As shown in FIG. 2, the inner surface 212 of the striking wall 210 includes a center region 220 that corresponds approximately with a preferred golf ball striking area of the outer surface 211 known as the "the sweet spot". An exemplary representation of a sweet spot is illustrated in FIG. 2 by the area encompassed within the dashed line 213. A perimeter flange 240 surrounds the center region 220, and includes a heel region 221, a crown region 222, a toe region 223, and a sole region 224. The striking wall 210 may be constructed with a variable thickness that changes over one or more lengths extending between either a bisecting line A-A and the rim 230 or between a neutral point B of the striking wall 210 and the rim 230. The neutral point B is the point at which the neutral axis extends through the striking wall 210, the neutral axis being an axis that passes through the center of gravity and that also passes through the striking wall 210 in a normal orientation (e.g., with a 90° angle between the axis and the outer surface 211).

Figure 3:
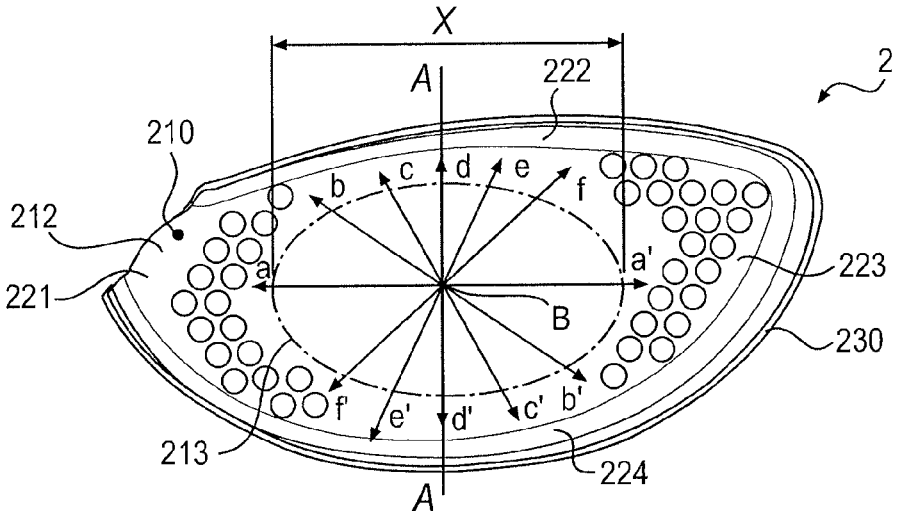
FIG. 3 illustrates another view of the golf club face shown in FIG. 2.

In a first aspect, the striking wall 210 may increase in thickness over lengths extending in all radial directions between the neutral point B and the rim 230. This change in thickness over the radial lengths may span over the entirety of each radial length, or may span over only a portion of each radial length. For example, as shown in FIG. 3, the striking wall 210 may change in thickness over the entirety of each radial length by continually increasing in thickness over the whole length from the neutral point B to the rim 230 in all radial directions, such as the directions a-a', b-b', c-c', d-d', e-e', and f-f'. In another example, the striking wall 210 may change in thickness over only a portion of each radial length, such as lengths extending in directions a/a', b/b', c/c', d/d', e/e', f/f', and etc., by having a constant thickness over a first portion of each radial length (such as a portion extending from the neutral point B to the sweet spot periphery 213), and may then continually increase in thickness over a second portion of each radial length (such as a portion extending from the sweet spot periphery 213 to the rim 230).

In a second aspect, the striking wall 210 may increase in thickness over only lengths that extend in horizontal directions between the bisecting line A-A and the rim 230 with no change in thickness over lengths extending in the vertical directions. This change in thickness over horizontal lengths may span over the entirety of each horizontal length, or may span over only a portion of each horizontal length. For example, as shown in FIG. 3, the striking wall 210 may change in thickness over the entirety of each horizontal length, such as lengths extending in the directions a/a', and etc., by continually increasing in thickness over the entire length from the bisecting line A-A to the rim 230 in all horizontal directions. In another example, the striking wall 210 may change in thickness over only a portion of each horizontal length by having a constant thickness over a first portion of each horizontal length corresponding to a predetermined distance X from the bisecting line A-A, and may then continually increase in thickness over a second portion of each horizontal length extending from the end of the predetermined distance X to the rim 230. The predetermined distance X, as measured from the bisecting line A-A toward the rim 230 in one or both of the heel region 221 direction and the toe region 223 direction, is about 5 mm to about 40 mm, preferably about 10 mm to about 30 mm, and preferably about 15 mm to about 25 mm.

Figure 4:
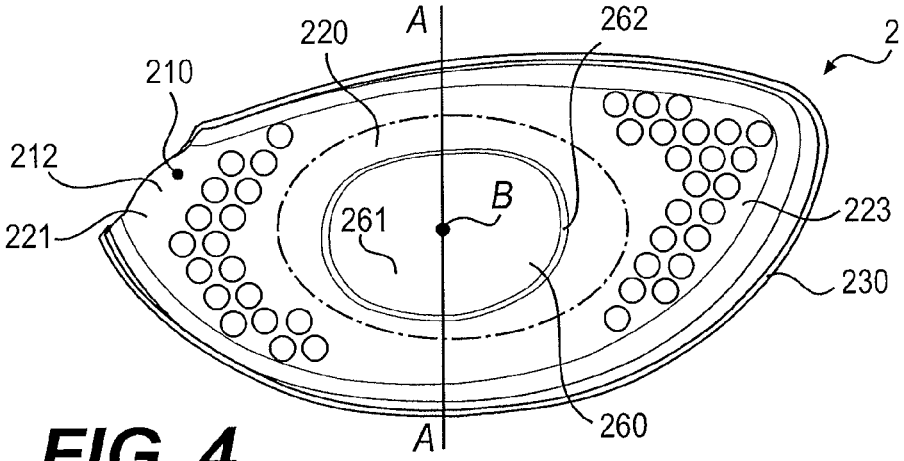
FIG. 4 illustrates another view of the golf club face shown in FIG. 2, with a first reinforcement region configuration.
Figure 5:
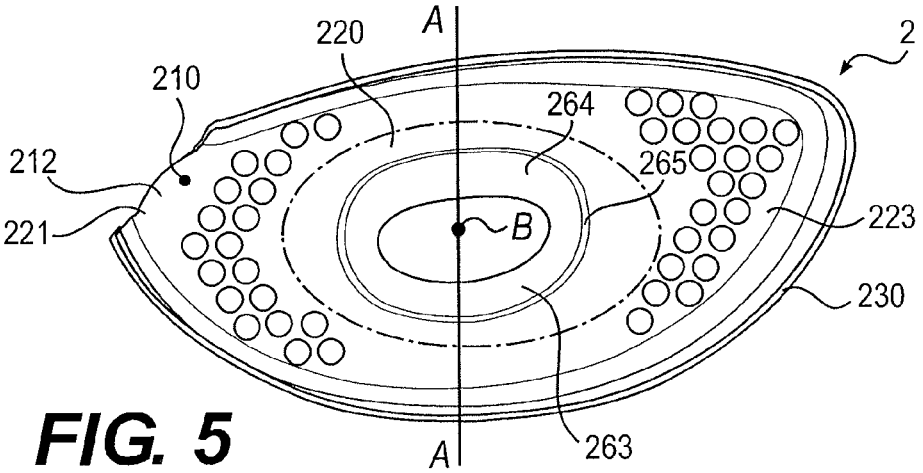
FIG. 5 illustrates another view of the golf club face shown in FIG. 2, with a second reinforcement region configuration.

In a third aspect, the striking wall 210 may increase in thickness and decrease in thickness over one or more sequential portions of a length along the striking wall 210. In particular, the striking wall 210 may include a reinforcing region 260/263 (as shown in FIGS. 4-5) that provides an increased thickness to the center region 220 of the striking wall 210 as compared to the other regions of the striking wall 210. In one example, as shown in FIG. 4, a disc-shaped reinforcing region 260 may be formed on the surface 212, and may include a top surface 261 of constant thickness and an outer transition surface 262 that decreases in thickness over lengths extending away from either the neutral point B or the bisecting line A-A. In another example, as shown in FIG. 5, a ring-shaped reinforcing region 263 may be formed on the surface 212, and may include an inner transition surface 264, which increases in thickness over lengths extending away from either the neutral point B or the bisecting line A-A; and an outer transition surface 265 that decreases in thickness over lengths extending away from either the neutral point B or the bisecting line A-A. Although not shown in FIG. 5, the ring-shaped reinforcing region may further include a top flat surface of constant thickness extending between the inner transition surface 264 and the outer transition surface 265. The reinforcing region 260/263 may be integrally formed on the surface 212 or separately formed and attached to the surface 212.

In the examples of this third aspect, in addition to the variable thickness presented by the reinforcing region 260/263, the striking wall 210 may also have a variable thicknesses such as those described in the foregoing first and second aspects along one or more lengths a/a', b/b', c/c', d/d', e/e', f/f', and etc., of the striking wall 210 that are free of the reinforcing region 260/263 (e.g., both within the perimeter of an inner transition surface 264 and beyond the perimeter of an outer transition surface 262/265).

A change in thickness along a length of the striking wall 210, as described in the foregoing aspects, may take the form of a linearly changing thickness, or a non-linearly changing thickness. In particular, a constant thickness in the striking wall 210 is characterized by the outer surface 211 and the inner surface 212 extending substantially parallel with one another. In contrast, a linearly changing thickness in the striking wall 210 would be characterized by the inner surface 212 diverging from the outer surface 211 a constant slope over an extending length of the two surfaces 211/212. Alternatively, a non-linearly changing thickness in the striking wall 210 would be characterized by the inner surface 212 diverging from the outer surface 211 with configurations such as a non-constant sloping surface (e.g., a curved surface) or a stepped surface.

By constructing the striking wall 210 with a variable thickness that increases over lengths extending toward the rim 230, the perimeter regions of the striking plate 210 may be reinforced to provide increased durability against stresses incurred from striking a golf ball at a location off-center from the sweet spot. In particular, by providing a variable thickness that increases over horizontal lengths travelling away from the bisecting line A-A and toward the rim 230, such as lengths extending along the directions a/a' and etc., the striking wall 210 may be provided with an increased durability at both the heel region 221 the toe region 223. Alternatively, by providing a variable thickness that increases over all radial lengths travelling away from a neutral point B and toward the rim 230, such as lengths extending along the directions a/a', b/b', c/c', d/d', e/e', f/f', and etc., the striking plate 210 may be provided with an increased durability at both the heel region 221 and the toe region 223, as well as at both the crown region 222 and the sole region 224.

In addition, by providing a reinforcing region 260/263 to the center region 220 of the striking wall 210 it is possible to make fine adjustments to the striking characteristic of a sweet spot. In particular, by providing a disc-shaped reinforcing region 260, the sweet spot may be finely tuned to provide a stiffer striking surface at the center of the sweet spot. Alternatively, by providing a ring-shaped reinforcing region 263, the sweet spot may be finely tuned to provide an increased trampoline effect at the center of the sweet spot and a stiffer striking surface around the center of the sweet spot. These fine tune adjustments to the striking characteristic of the sweet spot may be used to influence a club head's trajectory accuracy.

The perimeter flange 240 is a portion of the striking wall 210 that extends about the center region 220 and includes the heel region 221, the crown region 222, the toe region 223, and the sole region 224. In examples where the striking wall 210 is constructed with a changing thickness that increases in directions travelling away from the neutral point B or away from a bisecting line A-A, one or more portions of the perimeter flange 240 will represent the thickest portions of the striking wall 210.

As discussed in more detail below, the club face may be constructed with a low modulus material (as compared to the modulus of elasticity of conventional face materials). However, the low modulus material has a higher density than conventional face materials. Accordingly, the use of such a low modulus material in the club face 2 will result in the club face having an increased weight as compared to club faces constructed from conventional materials, which results in a change to both the center of gravity and the moment of inertia of the club head and may also lead to a loss in maximum driving distance and/or a loss in trajectory accuracy. The increased weight of the club face 2 may be even greater if the club face 2 is constructed with a variable thickness such as that described in the foregoing aspects. Thus, the perimeter flange 240 may be constructed with a mass reduction configuration to decrease the overall weight of the club face 2. In particular, the mass reduction configuration removes volumes of the low modulus metal to decrease the overall weight of the club face 2 and counteract the negative influences that otherwise would result from the higher density of the low modulus metal as well as the use of a variable thickness configuration.

As shown in FIG. 2, the mass reduction configuration of the perimeter flange 240 may take the form of a cavity pattern 241, having a plurality of cavities 242 formed in the perimeter flange 240 to remove volumes of the low modulus metal. The cavities 242 are formed as blind holes, having a bottom surface within the striking wall 210. The cavity pattern 241 is preferably not present in the center region 220 of the inner surface. In some examples, the cavity pattern 241 may extend over each region 221/222/223/224 of the perimeter flange 240. However, it is also contemplated that the cavity pattern 241 be concentrated only in the heel and toe regions 221/223 to avoid any interference with the impacting performance of the sweet spot or undesirable stress patterns (e.g., such as when the crown and sole regions 222/224 are constructed with a relatively short vertical length). In one embodiment, the cavity pattern 241 is concentrated in the heel and toe regions 221/223. In another embodiment, the cavity pattern 241 is concentrated only in the heel region 221. In still another embodiment, the cavity pattern 241 is concentrated only in the toe region 223.

In examples where the cavity pattern 241 is limited to only the heel region 221 and/or the toe region 223, the pattern may begin at a preset distance Y from the bisecting line A-A measuring from about 5 mm to about 40 mm; preferably about 10 mm to about 35 mm; and more preferably about 15 mm to about 25 mm. In one embodiment, the pattern may begin at a preset distance Y from the bisecting line A-A measuring from about 18 mm to about 19 mm. In examples where the thickness of the striking wall 210 has a variable thickness configuration that continually increases in thickness over only a portion of a length extending from the end of a predetermined distance X, measured from either the neutral point B or the bisecting line A-A to the rim 230 (as shown in FIG. 3), the preset distance Y at which the cavity pattern 241 begins may: (a) be the same as the predetermined distance X (such that the cavity pattern 241 begins where the increase in thickness begins); (b) be shorter than the predetermined distance X (such that the cavity pattern 241 begins prior to where the increase in thickness begins); or (c) be longer than the predetermined distance X (such that the cavity pattern 241 begins beyond where the increase in thickness begins).

The overall thickness of the striking wall 210 may be between about 1.5 mm and about 3.5 mm; preferably between about 2.0 mm and about 3.4 mm; and more preferably between about 2.1 mm and about 3.3 mm. The thickness of the striking wall 210 at the perimeter flange 240 specifically may be between about 2.0 mm and about 2.5 mm; preferably between about 2.1 mm and about 2.4 mm; and more preferably between about 2.1 mm and about 2.3 mm. In areas where a cavity pattern is present, the thickness of the striking wall 210 is measured between the outer surface 211 and a webbing surface 214 of the cavity pattern 241 (and not from the blind bottom of a cavity 242). A depth of the cavities 242 may be between about 1.025 mm and about 1.125 mm; preferably between about 1.05 mm and about 1.1 mm; and more preferably about 1.0755 mm, with the depth being measured from the webbing surface 214 to the blind bottom of the cavity 242.

The plurality of cavities in the cavity pattern may be uniformly shaped, uniformly dimensioned, uniformly oriented, and/or uniformly spaced within the cavity pattern (e.g., each cavity in the pattern is equidistantly positioned from each immediately adjacent cavity in the pattern). In an alternate embodiment, the cavity pattern may include cavities that are not uniformly shaped, uniformly dimensioned, uniformly oriented, and/or uniformly spaced.

The cavity pattern may include as few as about five cavities, and as many as about 100 cavities. In one embodiment, the cavity pattern includes about 20 cavities to about 80 cavities. In another embodiment, the cavity pattern includes about 10 cavities to about 50 cavities.

Figure 6:
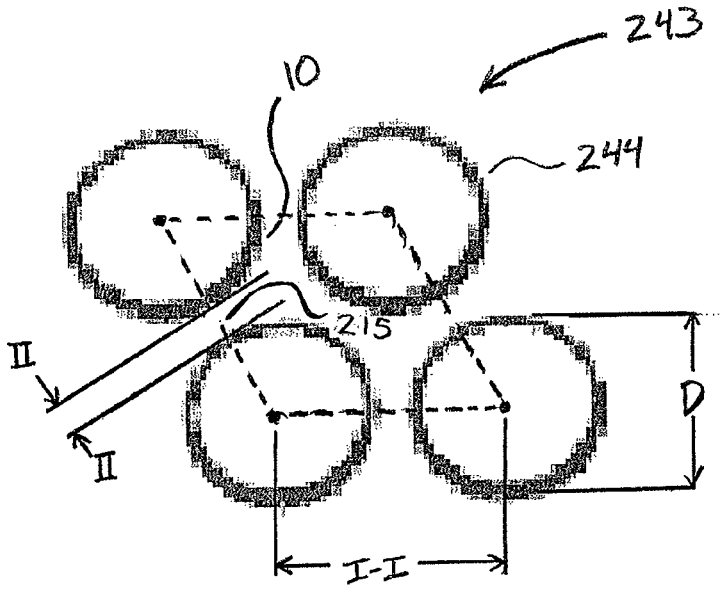
FIG. 6 illustrates a first cavity pattern of a mass reduction configuration of the golf club face shown in FIG. 2.

In one example, as shown in FIG. 6, a cavity pattern 243 may be formed from a plurality of circular-shaped cavities 244. The circular-shaped cavities 243 may have a diameter D of about 2.5 mm to about 6 mm; preferably about 3.0 mm to about 5.0 mm; and more preferably about 3.5 mm to about 4.5 mm. For example, the diameter D may be about 4.2 mm. The cavity pattern 243 may be characterized by a circle-center to circle-center distance I-I measuring about 4.0 mm to about 7.0 mm; preferably about 4.5 mm to about 6.5 mm; and more preferably about 6.0 mm to about 6.4 mm. For example, the circle-center to circle-center distance I-I may measure about 6.2 mm. The cavity pattern 243 may also be characterized by a webbing 215 that measures about 0.5 mm to about 3.0 mm (measured as a circle-perimeter to circle-perimeter distance); preferably about 1.0 mm to about 2.5 mm; and more preferably about 1.5 mm to about 2.25 mm, the webbing 215 being measured as circle-perimeter to circle-perimeter distance II-II. For example, the circle-perimeter to circle-perimeter distance II-II may be about 2.0 mm. The cavity pattern 243 may further be characterized by an area ratio (of cavity area to surface area within the pattern) of about 12 to about 22; preferably about 12.5 to about 21.5; and more preferably about 13 to about 20, the area ratio being measured within an area 10 defined between the centers of four circle cavities 244. For example, the ratio may be about 13.8 to about 19.4.

Figure 7:
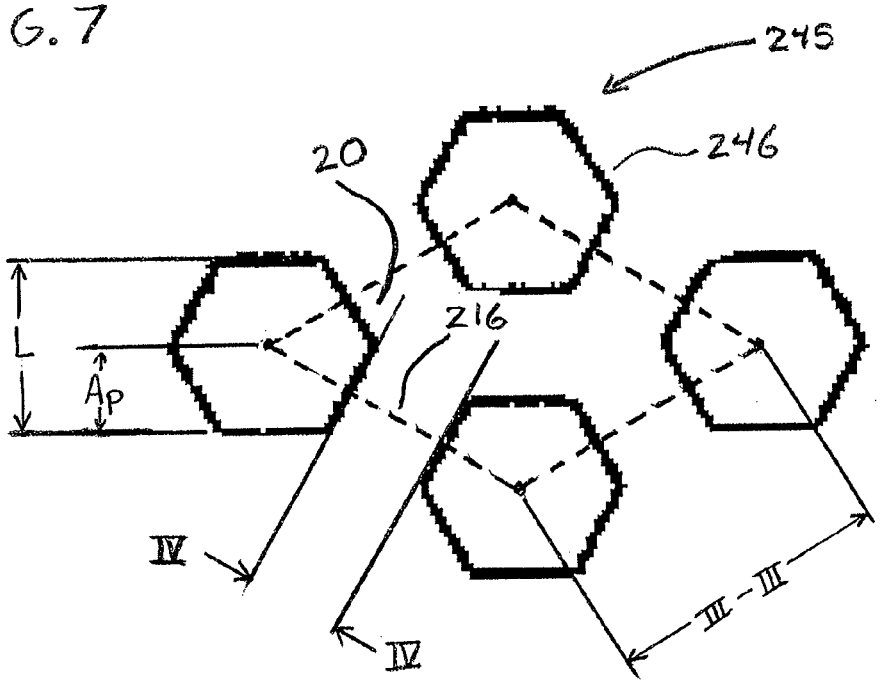
FIG. 7 illustrates a second cavity pattern of a mass reduction configuration of the golf club face shown in FIG. 2.

In another example, as shown in FIG. 7, a cavity pattern 245 may be formed from a plurality of regular hexagons 246, thereby presenting a honeycomb cavity pattern 245. The hexagons 246 may have an apothem Ap measuring about 1.25 mm to about 1.75 mm, preferably about 1.375 mm to about 1.625 mm, and more preferably about 1.61 mm. Stated otherwise, the hexagons may have a length L measuring about 2.5 mm to about 3.5 mm, preferably about 2.75 mm to about 3.25 mm, and more preferably about 1.85 mm, as measured between the center of a first a side in the hexagon and the center of the oppositely positioned side in the hexagon. In another embodiment, the length L may range from about 3 mm to about 5 mm (and ranges there between).

The cavity pattern 245 may be characterized by a hexagon-center to hexagon-center distance measuring about 4.5 mm to about 6.0 mm; preferably about 4.8 mm to about 5.8 mm; and more preferably about 5.1 mm to about 5.4 mm. For example, the hexagon-center to hexagon-center distance may measure about 5.26 mm.

The honeycomb cavity pattern 245 may be characterized by a webbing 216 that measures about 1.5 mm to about 4.5 mm; preferably about 1.75 mm to about 4.25 mm; and more preferably about 2 mm to about 4 mm, the webbing 216 being measured as hexagon-perimeter to hexagon-perimeter distance IV-IV. Without being bound by any particular theory, since stress tensors tend to localize in the webbing area during impact, the thickness of the webbing 216 should remain in the above ranges.

The honeycomb cavity pattern 245 may also be characterized by a hexagon-perimeter to hexagon-perimeter distance IV-IV, corresponding to an inner surface 212 webbing, that measures about 1.5 mm to about 2.5 mm; preferably about 1.75 mm to about 2.25 mm; and more preferably about 2 mm.

Figure 8:
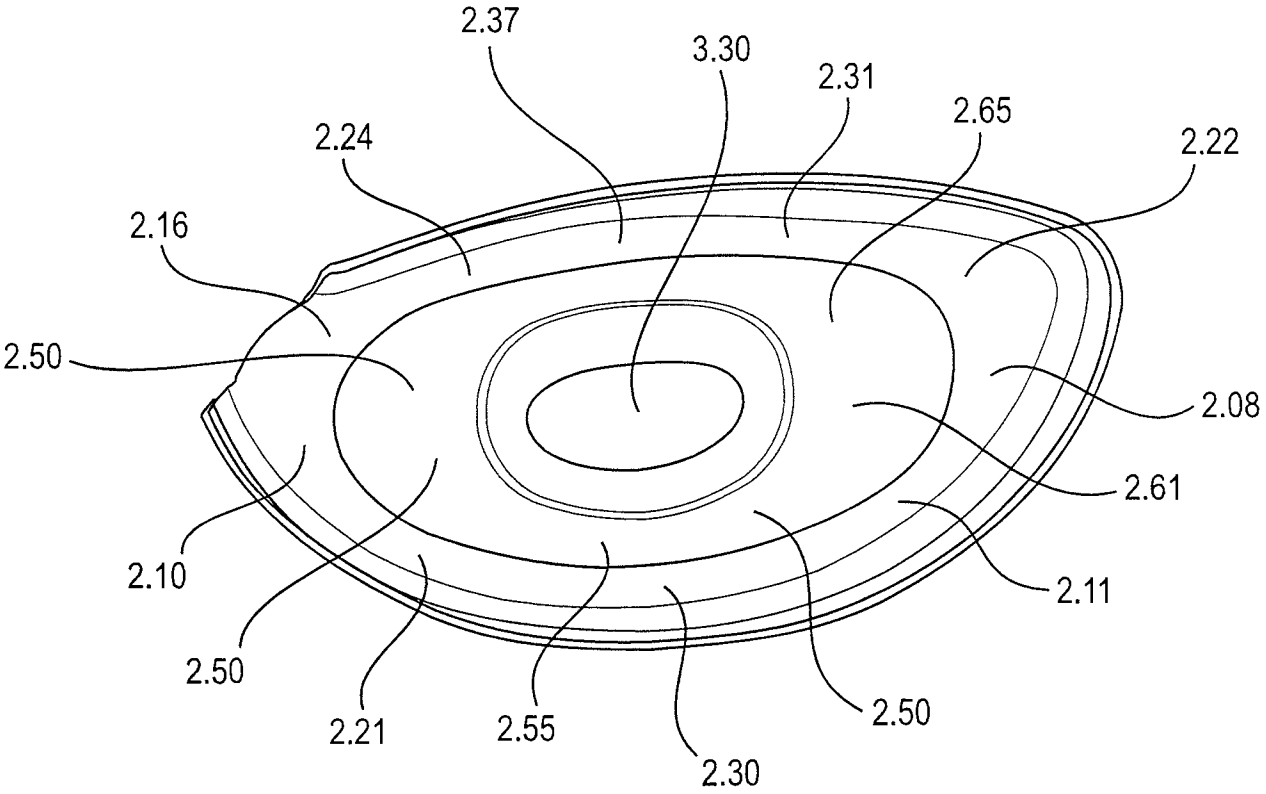
FIG. 8 illustrates a golf club face according to an embodiment of the present invention.

Distance V-V shown in FIG. 8 may range from about 4.5 mm to about 6.0 mm, preferably about 4.75 mm to about 5.75 mm; and more preferably about 5.0 mm to about 5.5 mm. For example, V-V may measure about 5.2 mm.

The honeycomb cavity pattern 245 may further be characterized by an area ratio (of cavity area to surface area within the pattern), as measured within an area 20 defined between the centers of four hexagon cavities 246, of about 8 to about 16, preferably about 8.5 to about 15.2, and more preferably about 9 to about 14.7.

In further examples, a cavity pattern may be formed with other desirably shaped cavities including, but not limited to: ovals, irregular hexagons, triangles (equilateral, isosceles, etc.), squares, rectangles, and other geometric shapes. In some examples, a cavity pattern may be formed with a combination of two or more of the foregoing shapes (including the circles and regular hexagons of FIGS. 6 and 7).

Method of Making the Club Face

The club face may be constructed from, at least in part, a material having a modulus of elasticity of about 16,000 kpsi or less. In one embodiment, the elastic modulus of the material used to form the club face is about 15,500 kpsi or less. In another embodiment, the club face material has an elastic modulus of about 15,000 kpsi or less. In still another embodiment, the elastic modulus of the material used to form the club face is about 14,500 kpsi or less. In yet another embodiment, the elastic modulus of the material is about 12,500 kpsi or less or 11,000 kpsi or less. In still another embodiment, the elastic modulus of the material is about 8500 kpsi or less.

The material used to form the club face has an elongation at break of less than 14 percent. In one embodiment, the material has an elongation at break of about 13 percent or less. In another embodiment, the elongation at break of the club face material is from about 3 percent to about 13 percent. In still another embodiment, the elongation at break of the club face material is about 6 to about 9 percent. In yet another embodiment, the elongation at break is about 6 percent to about 8 percent.

The density of the material used to form the club face may be greater than about 0.16 lb/in$^3$. In one embodiment, the material used to form the club face has a density of about 0.165 lb/in$^3$ or greater. In another embodiment, the material used to form the club face has a density of about 0.168 lb/in$^3$ or greater. In still another embodiment, the material used to form the club face has a density of about 0.17 lb/in$^3$ or greater. In yet another embodiment, the material used to form the club face has a density of about 0.172 lb/in$^3$ or greater. In yet another embodiment, the material used to form the club face has a density of about 0.174 lb/in$^3$ or greater. In still another embodiment, the material used to form the club face has a density of about 0.179 lb/in$^3$ or greater.

Suitable non-limiting examples of low modulus materials for use in the club face include Ti-15-3-3-3 (having a composition of Ti-15V-3Cr-3Sn-3Al), Ti-10-2-3 (having a composition of Ti-10V-2Fe-3Al), Ti-15-3, Ti-15-5-3, and combinations thereof.

The club face 2 may be constructed using metal shaping processes including, but not limited to, stamping, pressing, casting, forging, machining, and combinations of the foregoing.

The cavities 241/244/246 discussed above may be formed in the club face either during shaping of the club face itself, or after shaping of the club face. If the cavities are formed in the club face during the initial shaping of the club face, then the cavities may be formed by casting techniques. Alternatively, if the cavities are formed in the club face after the club face has been shaped, then the cavities may be formed by milling techniques. Suitable milling techniques include, but are not limited to, boring, computer numerical control milling (CNC milling), and the like. In addition, the cavities may be chemically etched or milled. As known to those of ordinary skill in the art, the chemical etching is a procedure that employs a chemical bath to remove any material not masked prior to immersion. In particular, the length of exposure to the chemical bath controls the amount of unmasked material that is removed.

Club Head Properties

By constructing a club face 2 from a low modulus material, the club face 2 may be configured to provide an assembled club head 1 (shown in an exploded view in FIG. 1) with an increased maximum drive potential (i.e., increased maximum COR and CT potentials). In particular, in one embodiment, the club face 2 may be configured to provide a club head 1 with a COR of about 0.800 to less than about 0.850 COR; preferably about 0.810 to about 0.830 COR; and more preferably about 0.820 to about 0.825 COR. If measured by CT, the club face 2 may be configured to provide the club head 1 with a CT of less than about 257 us; preferably about 250 us or less, and more preferably about 240 us or less.

In another aspect, the club head of the present invention may be used as a non-conforming driver. In other words, the COR and CT do not necessarily have to be in compliance with USGA regulations since the club head will be intended for recreational play only. In this regard, the club face 2 may be configured to provide a club head 1 with a COR of at least about 0.850 COR. If measured by CT, the club face 2 for use in a non-conforming golf club may be configured to provide the club head 1 with a CT of about greater than about 260 us. In one embodiment, the CT is greater than about 275 us. In another embodiment, the CT is greater than about 290 us. In still another embodiment, the CT is greater than about 300 us. In this manner, the club face 2 may be constructed to provide a maximum benefit, based on its intended user (e.g., a professional player, or a recreation player).

As generally discussed above, the club face 2 of the present invention facilitates the foregoing COR and CT potentials while at the same time accounting for negative influences that otherwise would result from the use of a low modulus material. In particular, the mass reduction configuration in the perimeter flange 240, such as the cavity patterns 243/245, reduces the overall mass and weight of the club face 2, thereby counteracting any negative effects that otherwise would have been conferred to the center of gravity and/or the moment of inertia due to the increased density of the low modulus metal. In addition, mass reduction configuration such as the cavity patterns 243/245 improve stress distribution over the striking wall 210 such that the heel and toe regions 221/223 are nearly stress-free and allow for a larger sweet spot.

EXAMPLES

The following non-limiting examples are merely illustrative of the preferred embodiments of the present invention, and are not to be construed as limiting the invention, the scope of which is defined by the appended claims.

Example 1: Durability Impact Testing

A durability impact test was conducted on a club face having a honeycomb cavity pattern formed in the heel and toe regions (such as the cavity pattern 245 shown in FIG. 7). The honeycomb cavity pattern included hexagon cavities characterized by: an apothem Ap of about 1.6 mm, a hexagon-center to hexagon-center distance of about 5.26 mm, a hexagon-perimeter to hexagon-perimeter distance IV-IV of about 2 mm, a distance V-V of about 5.2 mm, and a cavity depth of about 1.075 mm.

The honeycomb cavity pattern 245 began at a preset distance Y of about 30 mm from a bisecting line A-A measured in both directions towards the heel region 221 and the toe region 222 (as generally shown in FIG. 2).

As shown in FIG. 8, the striking wall 210 had a variable thickness from about 2.08 mm to about 3.30 mm, with the thickest portions I the geometric center of the face and the thinnest portions toe and heel flange areas.

The club face provided durable against impacts of up to at least 147 ft/sec (as tested by 2000 hits at the center, 500 hits high of the center, and 500 hits low of the center).

Other than in the operating examples, or unless otherwise expressly specified, all of the numerical ranges, amounts, values, and percentages, such as those for amounts of materials, moments of inertias, center of gravity locations, and others in the following portion of the specification, may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

For example, although the foregoing examples discuss the club face as a cup face insert, those skilled in the art will appreciate that the present invention is also applicable to club faces that are formed integrally with an aft body, or with an integral club body. In addition, although the foregoing examples discuss the club face being a club face insert for use in a two-piece golf club head, those skilled in the art will appreciate that the present invention is also applicable to multi-piece golf club heads having more than two pieces. Furthermore, although the foregoing examples discuss the club face as a club face for a metal wood, those skilled in the art will appreciate that the present invention is also applicable to club faces for use with irons and hybrids. The invention may also include further features, if desired, including features that are known and used in the art.

What is claimed is:

1. A golf club head comprising a face and a body, wherein the face comprises:

a striking wall comprising an outer surface configured to strike golf balls and an inner surface configured to face inward of the golf club head, wherein the striking wall is formed of a low modulus material, wherein the inner surface of the striking wall comprises a center region comprising at least two regions having different wall thicknesses, wherein the striking wall further comprises a perimeter flange, the perimeter flange comprising at least a toe area and a heel area of the face, wherein the perimeter flange comprises a mass reduction configuration in the form of a cavity pattern comprising a plurality of cavities, wherein the plurality of cavities are circular-shaped cavities having a diameter of about 3 mm to about 5 mm and are separated from one another by a webbing measuring about 2 mm to about 4 mm, and wherein the golf club head has a COR of at least about 0.850, a CT from at least about 302 us, or a combination thereof.

2. The golf club head of claim 1, wherein the center region comprises at least a first region having a first thickness between about 3 mm and about 4 mm and a second region having a second thickness between about 2.4 mm and about 2.8 mm, and wherein the second thickness is less than the first thickness.

3. The golf club head of claim 1, wherein the low modulus material has a modulus of elasticity of about 16,000 kpsi or less.

4. The golf club head of claim 1, wherein the low modulus material has a density of at least about 0.16 lb/in$^3$.

5. The golf club head of claim 1, wherein the low modulus material has a density of at least about 0.16 lb/in$^3$ and the modulus of elasticity of about 16,000 kpsi or less.

6. A golf club head comprising a face and a body, wherein the face comprises:

a striking wall comprising an outer surface configured to strike golf balls and an inner surface configured to face inward of the golf club head, wherein the striking wall is formed of a low modulus material, wherein the inner surface of the striking wall comprises a center region comprising at least two regions having different wall thicknesses, wherein the striking wall further comprises a perimeter flange, the perimeter flange comprising at least a toe area and a heel area of the face, wherein the perimeter flange comprises a mass reduction configuration in the form of a cavity pattern comprising a plurality of hexagon-shaped cavities each having an apothem of about 1.25 mm to about 1.75 mm, wherein each cavity in the plurality are separated from one another by a webbing measuring about 2 mm to about 4 mm, and wherein the golf club head has a COR of at least about 0.850, a CT from at least about 302 us, or a combination thereof.

7. The golf club head of claim 6, wherein the cavity pattern has an area ratio of cavity area to surface area that is from about 8:1 to about 20:1.

8. The golf club head of claim 6, wherein the face is a cup face insert configured for mating with the body.

9. The golf club head of claim 6, wherein the low modulus material has a modulus of elasticity of about 16,000 kpsi or less.

10. The golf club head of claim 6, wherein the low modulus material has a modulus of elasticity of about 8,500 kpsi or less.

11. The golf club head of claim 6, wherein the low modulus material has a density of at least about 0.16 lb/in$^3$.

12. A golf club head comprising a face and a body, wherein the face comprises:

a striking wall comprising an outer surface configured to strike golf balls and an inner surface configured to face inward of the golf club head;

wherein the inner surface of the striking wall comprises a center region, and the striking wall further comprises a perimeter flange, the perimeter flange comprising a plurality of regions on the inner surface of the striking wall that extend about the center region, wherein the perimeter flange comprises a mass reduction configuration in the form of a cavity pattern, wherein the cavity pattern comprises a plurality of cavities, and wherein each cavity in the plurality of cavities has a depth of about 1.025 mm to about 1.125 mm and are separated from one another by a webbing measuring about 2 mm to about 4 mm.

13. The golf club head of claim 12, wherein the cavity pattern has an area ratio of cavity area to surface area that is from about 8:1 to about 20:1.

14. The golf club head of claim 13, wherein the golf club head has a COR of about 0.800 to less than about 0.850, a CT of less than about 257 us, or a combination thereof.

15. The golf club head of claim 13, wherein the golf club head has a COR of at least about 0.850, a CT of greater than about 260 us, or a combination thereof.

16. The golf club head of claim 12, wherein the face is a cup face insert configured for mating with the body.

17. The golf club head of claim 12, wherein each cavity in the plurality of cavities is formed in at least one shape selected from the group consisting of circles, hexagons, triangles, squares, rectangles, and ovals.

18. The golf club head of claim 12, wherein the plurality of cavities comprises cavities formed in at least two different shapes.

19. The golf club head of claim 12, wherein the plurality of cavities comprises cavities formed in at least two shapes selected from the group consisting of circles, hexagons, triangles, squares, rectangles, and ovals.

20. The golf club head of claim 19, wherein the at least two shapes are circles and hexagons.

* * * * *